United States Patent [19]

Shinohara

[11] Patent Number: 4,876,938

[45] Date of Patent: Oct. 31, 1989

[54] ELECTRONIC MUSICAL INSTRUMENT WITH AUTOMATIC PERFORMING FUNCTION

[75] Inventor: Isao Shinohara, Tokyo, Japan

[73] Assignee: Casio Computer Co., Ltd., Tokyo, Japan

[21] Appl. No.: 287,619

[22] Filed: Dec. 16, 1988

Related U.S. Application Data

[63] Continuation of Ser. No. 654,053, Sep. 24, 1984, abandoned, which is a continuation of Ser. No. 433,047, Oct. 6, 1982, abandoned.

[30] Foreign Application Priority Data

Oct. 9, 1981 [JP] Japan ..... 56-161409

[51] Int. Cl.[4] ..... G10F 1/00

[52] U.S. Cl. ..... 84/611; 84/DIG. 22; 84/DIG. 12; 84/613

[58] Field of Search ..... 84/1.01, 1.03, 1.24, 84/DIG. 22, DIG. 12

[56] References Cited

U.S. PATENT DOCUMENTS 4,022,097 5/1977 Strangio ..... 84/1.03
4,343,218 8/1982 Futamase ..... 84/1.22
4,355,559 10/1982 Uya et al. ..... 84/1.01
4,361,067 11/1982 Ishii ..... 84/1.2

FOREIGN PATENT DOCUMENTS 2362037 6/1974 Fed. Rep. of Germany .
2837983 3/1980 Fed. Rep. of Germany .
3014403 10/1980 Fed. Rep. of Germany .
3036604 4/1981 Fed. Rep. of Germany .
3047801 10/1981 Fed. Rep. of Germany .

OTHER PUBLICATIONS

Copy and English translation of Official Action issued in West German Patent Office.

*Primary Examiner*—Forester W. Isen
*Attorney, Agent, or Firm*—Frishauf, Holtz, Goodman & Woodward

[57] ABSTRACT

Melody and chord tone data are read out from a melody RAM and a chord RAM under the control of address counters in a CPU, and are supplied to LSIs. The LSIs are controlled by the CPU for operation on a time division basis for a plurality of channels, so that a given melody and chord are simultaneously produced from a loudspeaker.

8 Claims, 15 Drawing Sheets

3A

FIG. 7
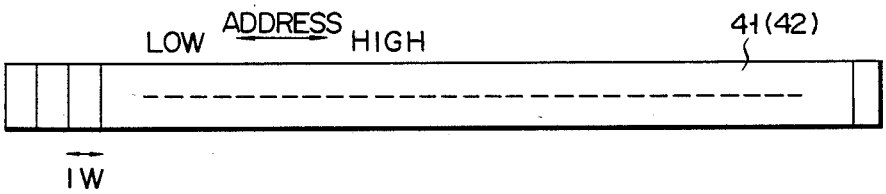
FIG. 8
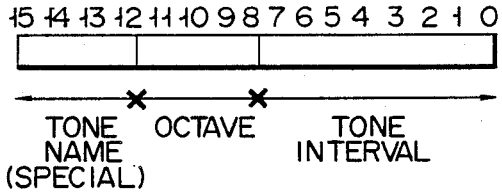
FIG. 9A
| DATA | TONE NAME |
|---|---|
| 0000 | C |
| 0001 | C# |
| 0010 | D |
| 0011 | D# |
| 0100 | E |
| 0101 | F |
| 0110 | F# |
| 0111 | G |
| 1000 | G# |
| 1001 | A |
| 1010 | A# |
| 1011 | B |
FIG. 9B
| DATA | OCTAVE |
|---|---|
| 0000 | C0~B0 |
| 0001 | C1~B1 |
| 0010 | C2~B2 |
| 0011 | C3~B3 |
| 0100 | C4~B4 |
| 0101 | C5~B5 |
| 0110 | C6~B6 |
| 0111 | C7~B7 |
FIG. 9C
| DATA | TONE INTER-VAL |
|---|---|
| 00000001 | 𝅘𝅥𝅯³⁻ |
| 00000010 | 𝅘𝅥𝅯³⁻ |
| 00000011 | 𝅘𝅥𝅯 |
| 00000100 | 𝅘𝅥𝅯³⁻ |
| 00000110 | 𝅘𝅥𝅯 |
| 00001000 | 𝅘𝅥𝅯³⁻ |
| 00001001 | 𝅘𝅥𝅯 |
| 00001100 | 𝅘𝅥 |
| 00010010 | 𝅘𝅥. |
| 00011000 | 𝅗𝅥 |
| 00100100 | 𝅗𝅥. |
| 00110000 | 𝅝 |
| 01001000 | 𝅝. |
| 01100000 | 𝄀 |
| 10010000 | 𝄀. |
| 11000000 | 𝄁 |
FIG. 9D
| DATA | SPECIAL MARK |
|---|---|
| 1100 | ⁄ |
| 1101 | RETURN |
| 1110 | SYNC START MARK FOR CHORD PERFORMANCE INITIATION |
| 1111 | END |

| DATA | CLASSIFICATION |
|---|---|
| 0 0 0 0 | ROOT ONLY |
| 0 0 0 1 | Major |
| 0 0 1 0 | Minor |
| 0 0 1 1 | Dominant 7th |
| 0 1 0 0 | Minor 7th |
| 0 1 0 1 | Major 7th |
| 0 1 1 0 | Diminished 7th |
| 0 1 1 1 | Augmented |

FIG. 12

| MODE | MELODY (AUTO) | MELODY (ONE-KEY PLAY) | CHORD (AUTO) | MELODY (MANUAL) | CHORD (MANUAL) |
|---|---|---|---|---|---|
| 1 | ○ | | | | |
| 2 | | ○ | | | |
| 3 | | | ○ | | |
| 4 | ○ | | ○ | | |
| 5 | ○ | | | ○ | |
| 6 | ○ | | | | ○ |
| 7 | | ○ | ○ | | |
| 8 | | | ○ | ○ | |
| 9 | ○ | | ○ | ○ | |

FIG. 13

| | MODE | LSI 45 ch1 | ch2 | ch3 | ch4 | LSI 46 ch1 | ch2 | ch3 | ch4 | LSI 47 ch1 | ch2 | ch3 | ch4 |
|---|---|---|---|---|---|---|---|---|---|---|---|---|---|
| | 1 | MELODY (AUTO) | | | | | | | | | | | |
| MELODY (ONE-KEY PLAY) | 2 | | | | | | | | | | | | |
| | 3 | | | | | CHORD (AUTO) | | | | BASS (AUTO) | ARPEGGIO (AUTO) | | |
| | 4 | MELODY (AUTO) | | | | CHORD (AUTO) | | | | BASS (AUTO) | ARPEGGIO (AUTO) | | |
| | 5 | MELODY (AUTO) | | MELODY (MANUAL) | | MELODY (MANUAL) | | | | | | | |
| | 6 | MELODY (AUTO) | | | | CHORD (AUTO) | | | | BASS (AUTO) | ARPEGGIO (AUTO) | | |
| MELODY (ONE-KEY PLAY) | 7 | | | | | CHORD (AUTO) | | | | BASS (AUTO) | ARPEGGIO (AUTO) | | |
| | 8 | | | MELODY (MANUAL) | | CHORD (AUTO) | | | | BASS (AUTO) | ARPEGGIO (AUTO) | | |
| | 9 | MELODY (AUTO) | | MELODY (MANUAL) | | CHORD (AUTO) | | | | BASS (AUTO) | ARPEGGIO (AUTO) | | |

ELECTRONIC MUSICAL INSTRUMENT WITH AUTOMATIC PERFORMING FUNCTION

This application is a continuation of application Ser. No. 654,053, filed Sept. 24, 1984, which was a continuation of Ser. No. 433,047 filed Oct. 6, 1982, both abandoned.

BACKGROUND OF THE INVENTION

This invention relates to an electronic musical instrument having a function of automatic melody/chord performance.

The prior art electronic musical instruments with automatic performing function include one which has a function of only automatic melody or chord performance, and one in which one-key melody performance can be made by reading out a series of tone data for a melody one by one from a memory every time a one-key play switch is operated.

These electronic musical instruments, however, have only simple automatic performing functions, and an electronic musical instrument with which more sophisticated musical performance can be enjoyed has long been desired.

For example, if melody performance and chord performance can be automatically obtained simultaneously, the user may sing a song to the automatically-performed music or perform a piece of music to an accompaniment provided by a different musical instrument. This cannot be done with the prior art electronic musical instrument with which only one automatic performing function can be obtained. Further, if melody performance using a one-key play key or ordinary manual performance can be made in addition to automatic melody and/or chord performance, a large variety of performance modes can be obtained; that is, it is possible to permit a high degree of musical performance.

SUMMARY OF THE INVENTION

An object of the invention is to provide an electronic musical instrument which has an automatic performing function, with which various performance modes, such as automatic melody performance, automatic chord performance, one key melody performance, manual melody performance and manual chord performance can be provided, either solely or in suitable combinations.

According to the invention, the above object can be attained by an electronic musical instrument with an automatic performing function, which comprises means for storing melody and chord tone data, first automatic performance means for producing automatic performance by successively reading out melody tone data stored in the storing means, second automatic performance means for producing automatic performance by successively reading out chord tone data stored in the storing means, and control means for rendering operative either one of the first and second automatic performance means or both of these means simultaneously.

BRIEF DESCRIPTION OF THE DRAWINGS

FIG. 7 is a view showing the configuration of a RAM for storing melody or chord tone data;

FIG. 8 is a view showing the data format of melody tone data;

FIGS. 9A to 9D are views showing code data representing tone name, octave, tone interval and special mark;

FIG. 12 is a view showing available different modes including automatic melody performance mode, automatic chord performance mode, and various combinations of two or more different performance modes;

FIG. 13 is a view showing the relation between each of the performance modes shown in FIG. 12 and the corresponding LSI chip channel assignment;

DETAILED DESCRIPTION OF THE PREFERRED EMBODIMENT

Figure 1:
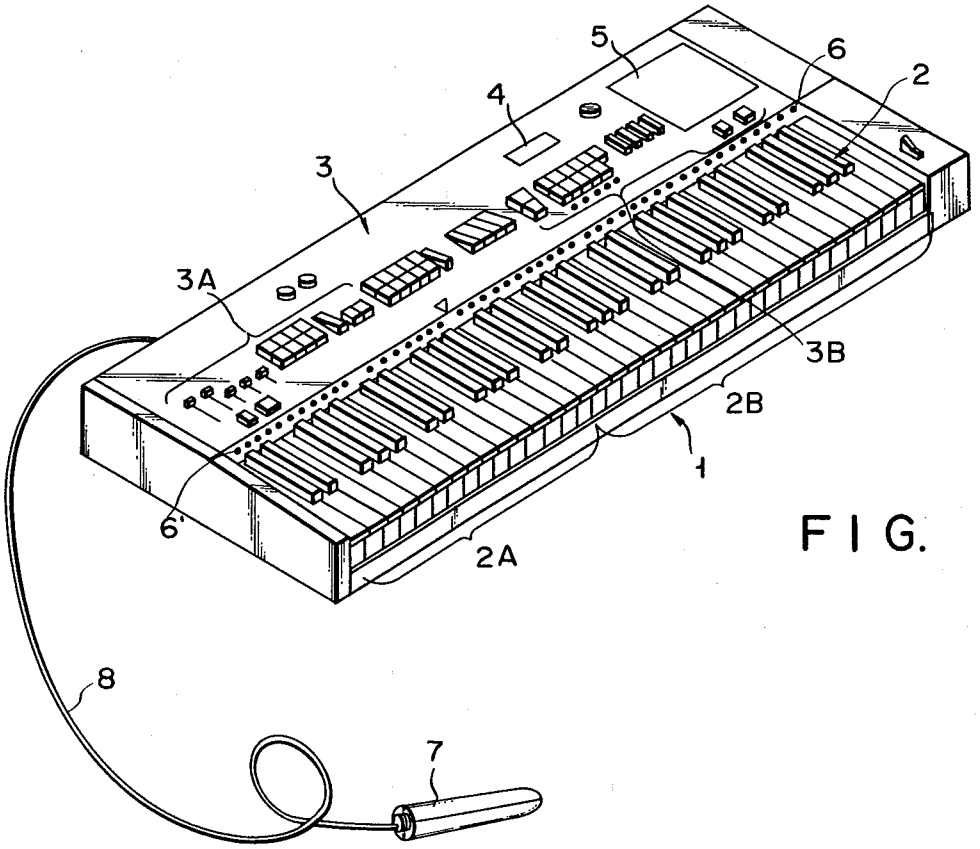
FIG. 1 is a perspective view showing an embodiment of the electronic musical instrument according to the invention.
Figure 4:
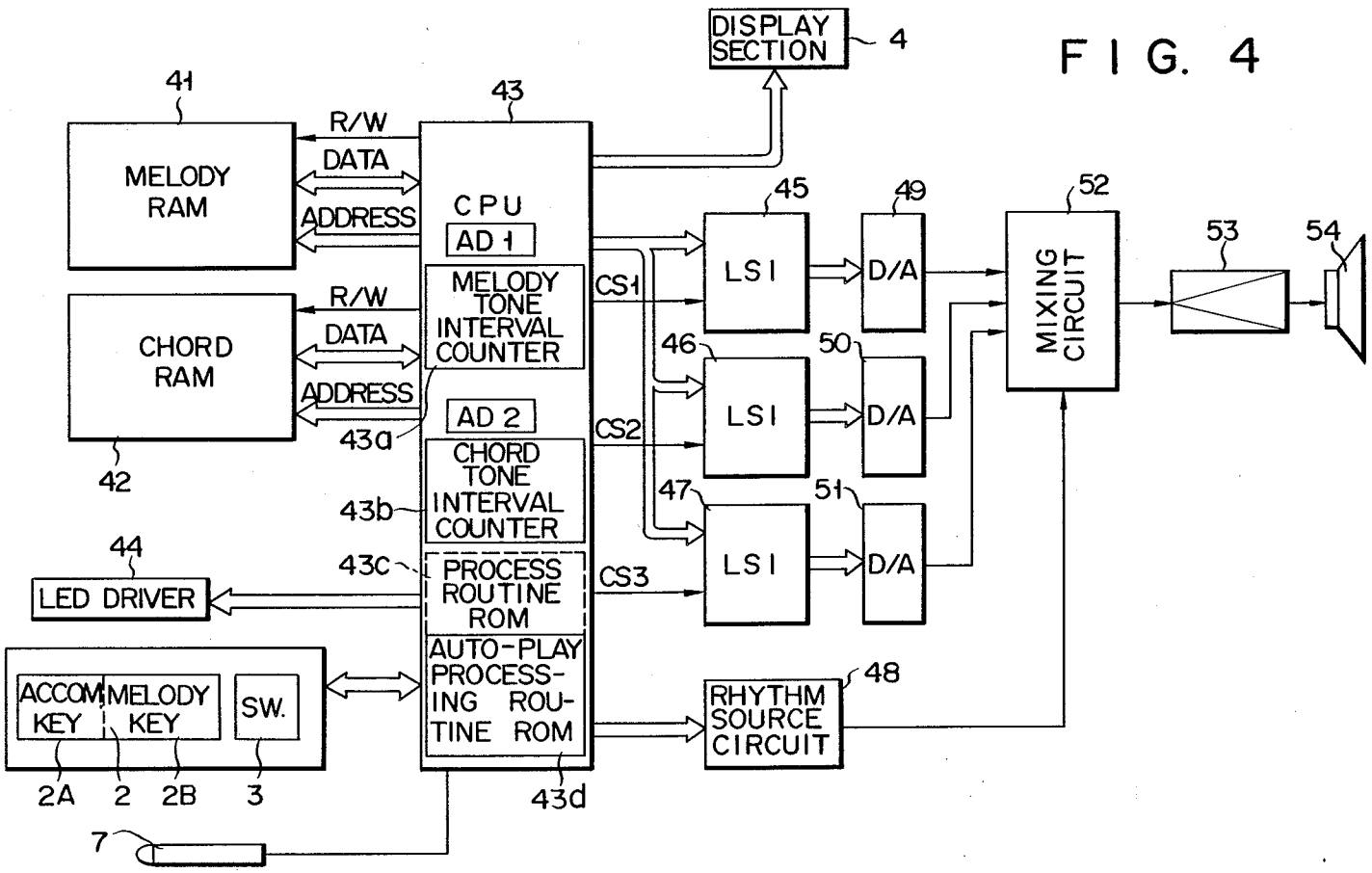
FIG. 4 is a block diagram showing the circuit construction of the embodiment of FIG. 1.
Figure 5:
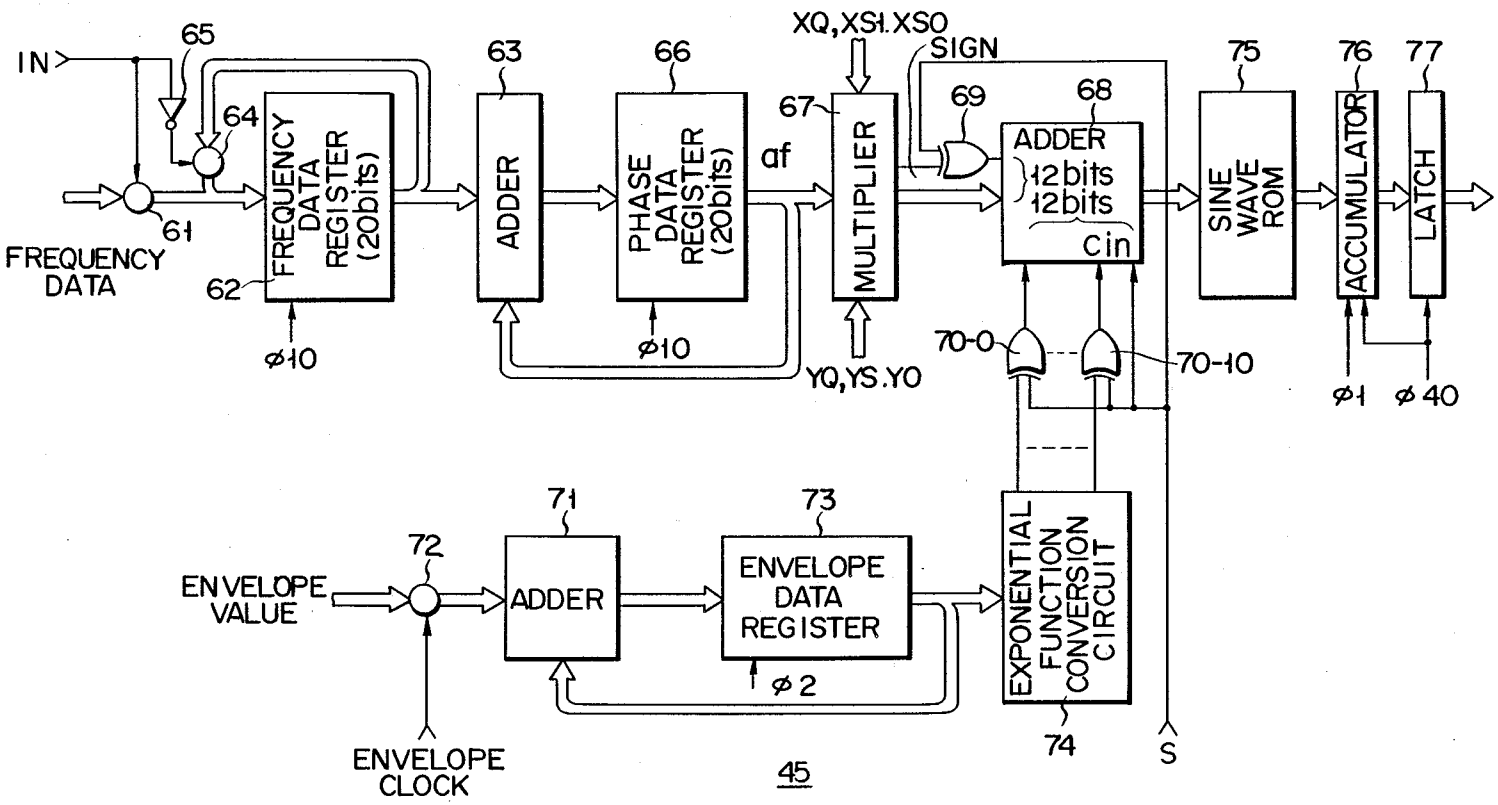
FIG. 5 is a block diagram showing the construction of an LSI chip shown in FIG. 4.

FIG. 1 shows a perspective view of an embodiment of the electronic musical instrument 1 according to the invention. The instrument 1 has a case, which is provided at the top with a keyboard 2, a switch panel 3, a display section 4, a sound producing section 5 and guide display members 6. Inside the case, there are provided electronic parts such as LSIs and a loudspeaker, the circuitry of which is shown in FIGS. 4 and 5. A bar code reader 7 is connected via a cord 8 to a circuit chassis inside the case.

The keyboard 2 has keys for five octaves as is shown. Of these keys, those for the lower two octaves can be used as accompaniment keys 2A, and those for the higher three octaves can be used as melody keys 2B. The switch panel 3 is provided with various switches. For the sake of simplicity, switches on the left hand side of the switch panel are collectively referred to as a switch group 3A as shown in FIG. 1, while the right hand switches are collectively referred to as a switch group 3B. The details of these switches will be described hereinafter with reference to FIGS. 2 and 3. The display section 4 is a liquid crystal display device or an LED display device which can digitally display numerical data of three digits. When writing a melody or chord into a melody RAM (random access memory) or a chord RAM to be described later, the display section displays the prevailing writing step number. The guide display members 6 are provided each for each of the melody keys 2B on the keyboard 6. They can serve to indicate a key to be operated next in a training performance. Each guide display member may be an LED (light-emitting diode). Further guide display members 6' are provided for some of the accompaniment keys 2A. They serve to show the root and kind of a chord. The bar code reader can read out melody and chord tone data recorded on a medium such as paper with bar code display means and supply the read-out tone data to the melody and chord RAMs.

Figure 2:
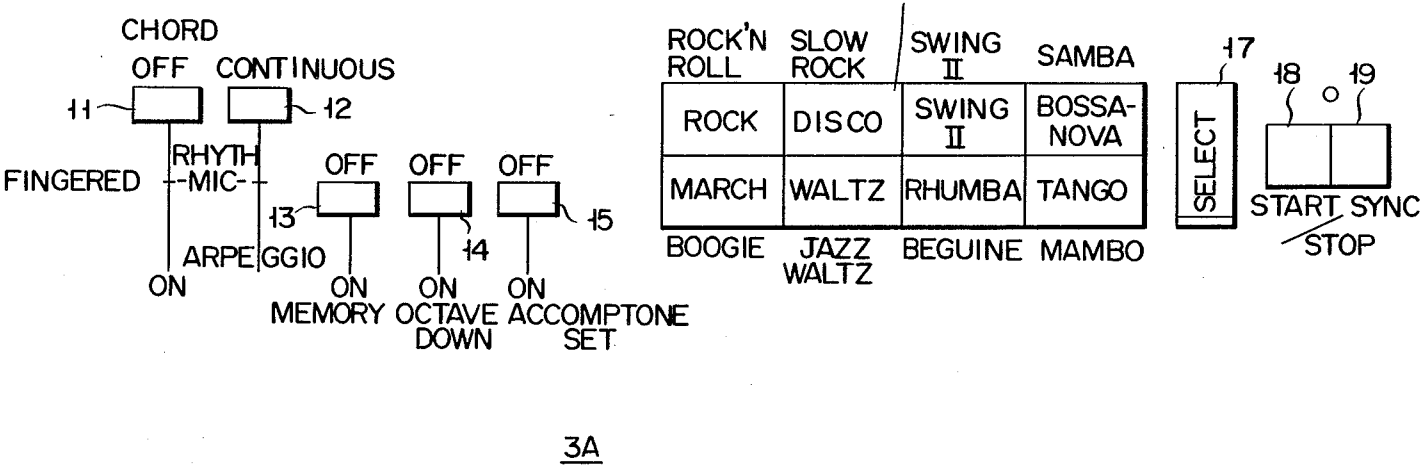
FIGS. 2 and 3 are plan views showing different portions of a switch panel shown in FIG. 1.

The switch groups 3A and 3B will now be described with reference to FIGS. 2 and 3. Referring to FIG. 2, a CHORD switch 11 is a switch for producing chord performance. This switch has a FINGERED position for ordinary fingered performance using three or more fingers at a time and an ON position for performance with one finger. For the chord performance, the accompaniment keys 2A are used. The one finger performance is for beginners. In this case, either only a key for specifying a root is operated (for major), or a key for specifying the lowest note as root and two or more other keys are operated (for minor or 7th). When the switch is in an OFF position, the automatic chord performance cannot be produced.

A switch 12 has a CONTINUOUS position, a RHYTHMIC position and an ARPEGGIO position. When the switch is in any of these positions, chord performance can be produced in a corresponding state. A memory switch 13 serves to memorize and hold the state of chord performance set by the switch 12.

An OCTAVE DOWN switch 14 is for lowering the octave of the melody keys 2B by one octave. A switch 15 is for setting the tone color of accompaniment. This switch is used together with a tone color selection switch (which permits selection of a plurality of different tone colors such as piano, flute, etc., and which is not shown).

A rhythm switch 16 is for selecting a rhythm from among $8\times2=16$ different rhythms such as rock, as shown. This switch is operated together with a SELECT switch 17. A START/STOP switch 18 can permit automatic accompaniment of the specified rhythm from the instant of its operation. A SYNC switch 19 can permit automatic accompaniment from an instant of operation of accompaniment keys 2A on the keyboard 2.

Figure 3:
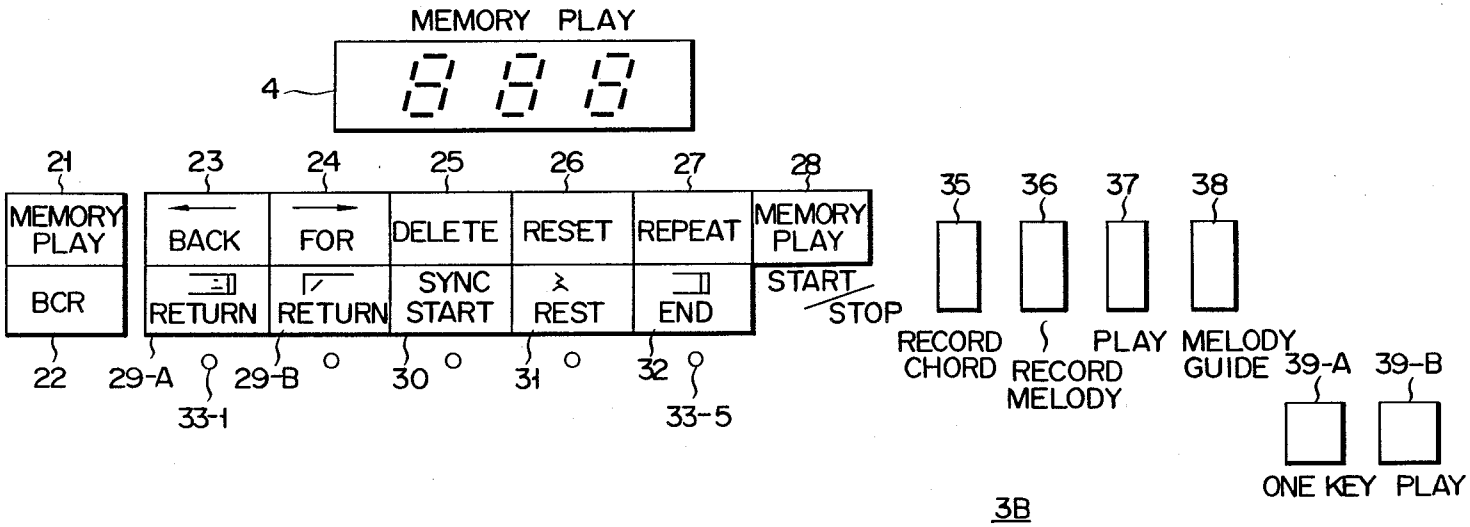

Referring to FIG. 3, a MEMORY PLAY switch 21 is one which is first turned on when making a memory play using a melody RAM and chord RAM. A BCR switch 22 is one which is first turned on when reading data from the medium with the bar code reader 7 and coupling the readout data to the RAMs. A BACK switch 23 and a FOR switch 24 are for manually shifting the RAM address backwards and forwards respectively. A DELETE switch 25 is for deleting RAM data. A RESET switch 26 is for resetting circuits when writing data into or reading data out of the RAMs. A REPEAT switch 27 is for coupling the number of times of automatic performance to be produced. A MEMORY PLAY START/STOP switch 28 is for starting or stopping automatic performance. RETURN switches 29-A and 29-B are for producing return performance. When writing melody or chord data into the melody RAM or chord RAM, these switches are operated in the start bar and end bar among the bars of return performance.

A SYNC START switch 30 is for entering a sync start mark at a desired point when writing melody or chord data into a RAM. When the sync start mark is read out from the melody RAM at the time of the automatic performance, chord and rhythm performance is started to accompany the melody performance from that instant. A REST switch 31 is for entering a rest mark. An END switch 32 is for entering an end mark. LED display members 33-1 to 33-5 are provided for each of the switches 29-A, 29-B and 30 to 32, and they are turned on when pertaining data is read out in the ON state of the associated switch or during automatic performance.

A RECORD CHORD switch 35 is for specifying a mode of recording chord data in a RAM. A RECORD MELODY switch 36 is for specifying a mode of recording melody data in a RAM. A PLAY switch 37 is operated when making a memory play performance. A MELODY GUIDE switch 38 is for specifying a melody guide mode for training performance. ONE KEY PLAY switches 39-A and 39-B are provided for one-key play performance by successively reading out a series of melody note data from the melody RAM in which only these note data are recorded. When writing melody or chord data into a RAM, the tone interval is coupled by operating the ONE-KEY PLAY switches 39-A and 39-B.

The construction of the circuitry will now be described with reference to FIGS. 4 and 5. FIG. 4 shows a melody RAM 41 and a chord RAM 42, respectively, and a CPU 43 (central processing unit). The CPU may consist of a one-chip microprocessor, and it controls all operations for producing tones in the electronic musical instrument 1. To this end, the CPU 43 includes an address counter AD1 corresponding to the melody RAM 41, an associated melody tone interval counter 43*a*, an address counter AD2 corresponding to the chord RAM 42 and an associated chord tone interval counter 43*b*. The melody tone interval counter 43*a* and chord tone interval counter 43*b* are used when recording the melody or chord tone interval data using the ONE-KEY PLAY switch 39-A or 39-B or at the time of automatic performance. The transfer of melody and chord data between the CPU 43 and the melody and chord RAMs 41 and 42 is effected according to the address data of the address counters AD1 and AD2. At this time, the CPU 43 supplies a read/write signal R/W to the RAMs 41 and 42.

The CPU 43 further scans the keyboard 2 and switch panel 3 to detect the "on" or "off" state of the individual keys and switches and process data representing the detected state of keys and switches. The CPU 43 further controls the display operation of the display section 4 and an LED driver 44 for controlling the display operation of the guide display members 6 or chord display members 6' or reading operation of the bar code reader 7. The CPU 43 includes a data processing routine ROM (read only memory) 43*c* for the control of the various operations mentioned above.

The CPU 43 further controls the operation of three LSI chips 45, 46 and 47 and a rhythm source circuit 48 which is an analog circuit. The LSI chips 45 to 47 are circuits for generating tones according to the key operation output from the keyboard 2 and also to switch outputs of various switches on the switch panel 3. The rhythm source circuit 48 is a circuit for selectively producing the aforementioned 16 different rhythms. The outputs of the LSI chips 45 to 47 are coupled through respective D/A converters 49 to 51 to a mixing circuit 52. The output of the rhythm source circuit 48 is directly coupled to the mixing circuit 52. The output of the mixing circuit 52 is coupled through an amplifier 53 to a loudspeaker 54 which is provided in the sound producing section 5 for producing musical sound. The CPU 43 provides chip select signals CS1 to CS3 for selecting the respective LSI chips 45 to 47. The CPU 43 further includes an auto-play processing routine ROM 43*d* for producing the automatic performance.

The LSI chips 45 to 47 all have the same circuit construction as shown in FIG. 5. The individual LSI chips 45 to 47 provide waveform data representing tones including harmonic tones of the order numbers specified by the CPU 43. These waveform data are supplied to the respective D/A converters 49 to 51.

The construction of the LSI chips 45 to 47 will now be described in detail with reference to FIG. 5. Since the LSI chips 45 to 47 all have the same construction as mentioned earlier, the LSI chip 45 will be described in detail.

The LSI chip 45 is capable of operation on a time division basis for four channels. Each channel may be assigned for one tone. That is, the LSI can produce up to 4 tones at a time, i.e., a 4-component chord. Accordingly, various shift registers such as frequency data registers to be described later each have four shift stages for the respective four channels. However, an envelope data register to be described later has 20 shift stages.

Figure 6:
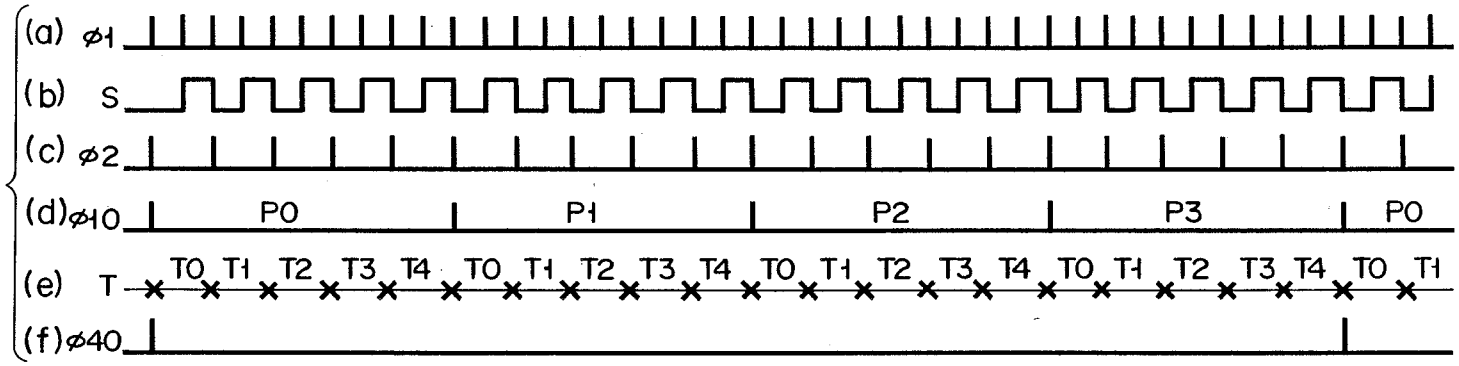
FIG. 6 is a timing chart for explaining the operation of an LSI chip shown in FIG. 5.

Frequency data of operated keys, which are provided from the CPU 43 according to the octaves of operated keys and coupled to the LSI chip 45, are supplied through a gate circuit 61 to a frequency data register 62. The frequency data register 62 includes four 20-bit shift registers connected in cascade. The register 62 is driven for shifting operation by a clock signal $\phi$10 (see FIG. 6). Frequency data provided from the fourth stage shift register of the frequency data register 62 is fed to an adder 63 and is also fed back to the first stage shift register of the frequency data register 62 through a gate circuit 64. A control signal IN from the CPU 43 is supplied to the gate circuit 61 directly and also to the gate circuit 64 through an inverter 65 for on-off controlling these gate circuits. The control signal IN is one which is provided as a binary logic level "1" signal when an operated key is assigned to a channel. It is provided at the timing of that channel. With this signal IN the gate circuit 61 is opened to pass the frequency data corresponding to the operated key to the first stage of the frequency data register 62. At this time, the gate circuit 64 is in the closed state to block the data fed back from the fourth stage of the frequency data register 62. Subsequently, the control signal IN is changed to a "0" signal and is held as such for the time period of the pertaining channel till the channel is released with the release of the operated key. With the change of the control signal IN to "0" the gate circuit 64 is opened so that the frequency data of the operated key is fed back. In this way, the data is held circulated.

The adder 63 adds the frequency data from the frequency data register 62 and phase data (phase address) fed back from a phase data register 66 and supplies the result as new phase data to the phase data register 66. The phase data register 66 includes four 20-bit shift registers connected in cascade. It is driven by the clock signal $\phi$10. Phase data provided from the fourth stage of the phase data register 66 is fed to a multiplier 67. The adder 63 and phase data register 66 constitute a circuit for accumulating the frequency data to obtain a phase address af.

To the multiplier 67, signals XS0, XS1, XQ, YO, YS2 and YQ are supplied under the control of the CPU 43. The signals XS0, XS1 and XQ are gate control signals such that the phase address af as mentioned above, data which is double the phase address af, and the result of the previous calculation are supplied to an X input terminal of an adder in the multiplier 67. The signals Y0, YS2 and TQ are gate control signals such that data 0, data which is four times the phase address af and the result of the previous calculation are supplied to a Y input terminal of the adder. The output data of the multiplier 67 is fed to a first input terminal group of the adder 68. Of the output data (12-bit data) of the multiplier 67, the highest place bit is a sign bit representing the sign of data, and it is fed through an exclusive OR gate 69 to an adder 68. Envelope data (11-bit data) is fed through exclusive OR gates 70-10 to 70-0 to a second input terminal group of the adder 68.

To the adder 71 an envelope value is supplied through a gate circuit 72. The envelope value data is one which is supplied under the control of the CPU 43 according to ADSR (attack, decay, sustain, release) data previously set by an external switch when a performance key is depressed and released. It is supplied to the adder 71 every time the gate circuit 72 is opened by an envelope clock supplied to the gate circuit 72.

Data from an envelope data register 73 is fed back to the adder 71. The envelope data register 73 includes twenty 7-bit shift registers connected in cascade. It is driven by a clock signal $\phi$2 (see FIG. 6). The adder 71 adds the envelope value data and the output data from the envelope data register 73 to produce new envelope data (prevailing value of envelope) which is fed to the envelope data register 73. The output data of the envelope data register 73, i.e., the envelope data, is also fed to an exponential function conversion circuit 74. The exponential function conversion circuit 74 is one which converts the envelope data into data representing exponential changes to provide an ideal envelope waveform having an upwardly convex attack section, a downwardly convex decay section and a downwardly convex release section. For the exponential function conversion circuit 74, one which is disclosed in U.S. Ser. No. 324,466 filed on Nov. 24, 1981 corresponding to Japanese Patent Application No. 36595/1981 filed earlier by the applicant, may be used. Envelope data provided from the exponential function conversion circuit 74 is fed through the exclusive OR gates 70-10 to 70-0 to the adder 68.

A signal S the level of which is alternately changed to "1" and "0" for every pulse of the system clock signal $\phi$1 is supplied to the other input terminal of the exclusive OR gate 69 and each of the exclusive OR gates 70-10 to 70-0. The signal S is further supplied to a carry input terminal Cin of the adder 68.

When the signal S is "0", the adder 68 adds the input data to the first input terminal group and the input data to the second input terminal group and supplies the result as address data to a sine wave ROM 75. When the signal S is "1", the adder 68 adds data which consists of the data from the multiplier 67 with only the sign bit inverted in level and the envelope data from the exponential function conversion circuit 74 in a 2's complement expression and supplies the result to the sine wave ROM 75. The sine wave that is read out when the signal S is "1", and the sine wave read out when shifted in the opposite directions though the extent of the phase shift is the same. Also, these sine waves have opposite signs.

Sine wave amplitude values sampled at $2^n$ sampling points (n being a positive integer and is n=18 in the present case) are stored in the sine wave ROM 75. The amplitude data read out from the sine wave ROM 75 are supplied to an accumulator 76 for accumulation for every pulse of the system clock signal $\phi 1$. The accumulated data in the accumulator 76 is latched in a latch 77 when a clock pulse $\phi 40$ (see FIG. 6) is provided. The latched data is supplied to the D/A converter 49 mentioned above. The content of the accumulator 76 is cleared with the timing of the clock $\phi 40$. The accumulated data latched in the latch 77 is a result of the accumulation of at most 40 sampled sine wave amplitudes.

With the construction of the LSI chip 45 as described above, the LSI chip 45 can operate on a time division basis for four channels to produce up to four tones at a time. The other LSI chips 46 and 47 have the same construction. Further details of the LSI chips 45 to 47 are disclosed in U.S. Ser. No. 324,466 filed on Nov. 24, 1981 corresponding to Japanese Patent Application No. 130875/1981 filed by the applicant and entitled "Electronic Musical Instrument".

The melody RAM 41 and chord RAM 42 (which have the same construction) will now be described with reference to FIGS. 7 to 11. FIG. 7 shows the configuration of the melody RAM 41. If the RAM 41 has 1,000 memory steps, data for one word can be stored in each step, and each word consists of 16 bits. Steps 0 to 999 are given respective addresses No. 0 to No. 999. An end mark is always written immediately after the end of melody data or chord data.

FIG. 8 shows data configuration of melody data (for one word) which is written into the RAM 41. One word consists of 16 bits as mentioned earlier. In the four higher place bits (bits No. 15 to No. 12) data representing a tone name or a special mark is stored (as will be described later). In the following four bits (bits No. 11 to No. 8) octave data (to be described later) is stored. In the following eight bits (bits No. 7 to No. 0) tone interval data is stored.

FIG. 9A shows tone name data (for tone names C to B). FIG. 9B shows octave data, in the present case octave data for eight octaves from the first octave (covering tones C0 to B0) to the eighth octave (covering tones C7 to B7). FIG. 9C shows tone interval data, i.e., 16 different tone interval data. FIG. 9D shows special mark data, i.e., data for a rest mark, a return mark, a sync start mark for chord performance initiation, and an end mark.

Figures 10, 11:
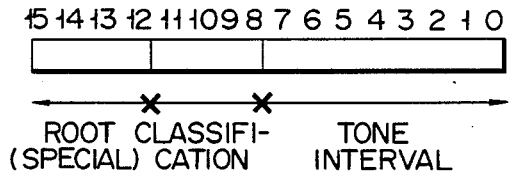
FIG. 10 is a view showing the data format of chord tone data.
FIG. 11 is a view showing code data representing various chords.
Figure 14:
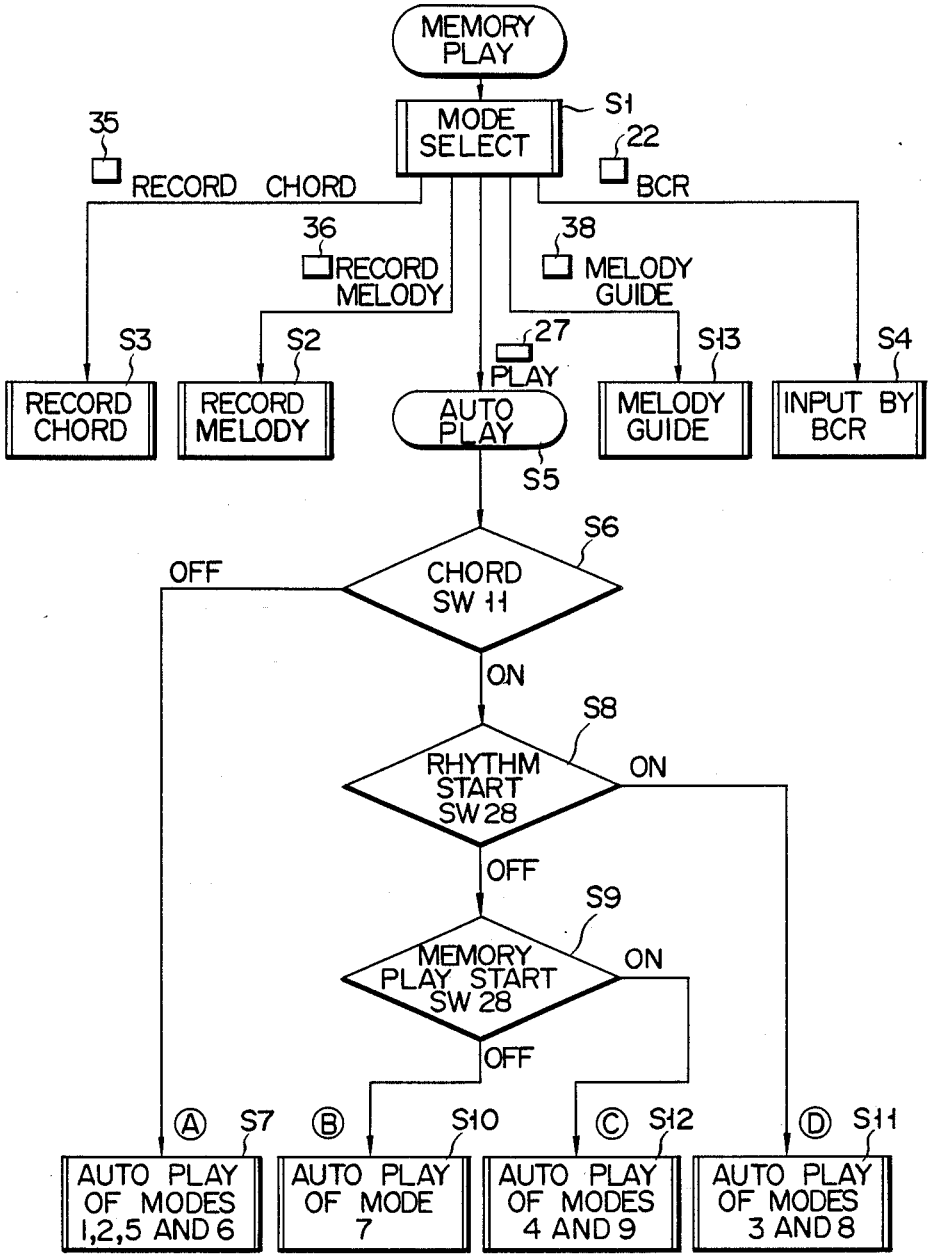
FIG. 14 is a flow chart for explaining the operation of selecting a given performance mode.

FIG. 10 shows the data configuration of chord data (for one word) stored in the chord RAM 42. The chord data again consists of 16 bits for each word. In the higher four bits (bits No. 15 to No. 12) the tone name of a root (as shown in FIG. 9A) or a special mark (as shown in FIG. 9D) is stored. In the following four bits (bits No. 11 to No. 8) chord classification data (to be described later) is stored. In the following eight bits (bits No. 7 to No. 0) tone interval data (as shown in FIG. 9C) is stored.

FIG. 11 shows the chord data classification. Eight different chords are considered for one root.

Melody data and chord data are written into the melody and chord RAMs 41 and 42 having the construction as described above using the keyboard 2 and switches 21 to 27, 29-A, 29-B, 32, 35, 36, 39-A and 39-B (see FIG. 3). The present embodiment of electronic musical instrument 1 permits nine different modes, including either auto-play or semiauto-play modes, as shown in FIG. 9.

In mode No. 1, melody is automatically performed using the melody RAM 41. In mode 2 melody is performed by one-key play. In mode No. 3, a chord is automatically performed using the chord RAM 42. Modes No. 4 to No. 8 are composite modes consisting of a combination of two independent modes. In mode No. 4 melody and chord are simultaneously and automatically performed. In mode No. 5 a melody is manually performed during the automatic performance of a melody. In mode No. 6 a chord is manually performed during the automatic performance of a melody. In mode No. 7 a melody is performed by one-key play during the automatic performance of a chord. In mode No. 8 melody is manually performed during the automatic performance of a chord. Mode No. 9 is one which is a combination of three independent modes, that is, melody is manually performed during automatic performance of melody and chord.

FIG. 13 shows the channel assignment of the LSI chips 45 to 47 for tone producing operation in the individual modes No. 1 to No. 9. In mode No. 1 the automatic performance of melody is executed in the first channel of the LSI chip 45. In mode No. 2 the melody performance by one-key play is again executed in the first channel of the LSI chip 45. In mode No. 3 the automatic performance of a chord is executed in the first to fourth channels of the LSI chip 46. At the same time, the automatic performances of bass and arpeggio are executed in the first or second channel of the LSI chip 47. In mode No. 4 the automatic performance of melody is executed in the first channel of the LSI chip while the automatic performance of bass and arpeggio are executed in the LSI chips 46 and 47 as in mode No. 3. In mode No. 5, the automatic performance of a melody is executed in the first channel of the LSI chip 45 while the manual performance of a melody is executed in the first to fourth channels of the LSI chip 45 and in the first to fourth channels of the LSI chip 46. In this case, at most seven tones of manual performance can be simultaneously produced. In the modes No. 6 to No. 9 performance is similarly executed with the channel assignment as shown in FIG. 13. In the mode No. 6 automatic performance of a chord is executed in the first to fourth channels of the LSI chip 46. In this case, in the automatic performance of a chord, the automatic performances of bass and arpeggio are also simultaneously executed. In modes No. 8 and No. 9 at most three tones are simultaneously produced in the manual performance of melody. The channel assignment is controlled by the CPU 43.

The operation of the electronic musical instrument 1 will now be described with reference to FIGS. 14 to 18. First, the main operation of the instrument 1 will be described with reference to FIG. 14.

When recording melody data in the melody RAM 41, after turning on a power switch, the MEMORY PLAY switch 21 is turned on, and then RECORD MELODY switch 36 is turned on (step S1). Then melody data is recorded using the keyboard 2 and switches such as the switch 23 (step S2). At this time, the CPU 43 drives the address counter AD1 for accessing addresses of the melody RAM 41. First, pitch data of a series of tones of melody are successively produced with the operation of keys on the keyboard 2 and are recorded in the melody RAM 41. After the recording of a series of pitch data has been completed, the address counter AD1 is reset. Then, a series of tone interval data corresponding to the pitch data previously recorded are recorded by operating the ONE-KEY PLAY switches 39-A and 39-B. In this case, the time from the "on" operation of the ONE-KEY PLAY switches 39-A and 39-B till the next "on"

operation is counted by the melody tone interval counter to obtain the tone interval data. Also, the prevailing step number of the RAM 41 is displayed on the display section 4, and the tones of the pitch data being input are produced in the LSI chips 45 to 47 and coupled to the sound producing section 5 for sound production.

When recording chord data in the chord RAM 42, after turning on the MEMORY PLAY switch 21 the RECORD CHORD switch 35 is turned on (step S1). Then, chord data are recorded in the same manner as in the recording of melody data (step S3). In this case, the address counter AD2 and chord tone interval counter 43*b* are driven.

When recording melody data and chord data in the melody RAM 41 and chord RAM 42 respectively by using the bar code reader 7, after turning on the MEMORY PLAY switch 21 the BCR switch 22 is turned on (step S1), and then the reading of bar code data with the bar code reader 7 is executed (step S4).

When producing performance in modes No. 1, No. 2, No. 5 or No. 6 after the melody and chord data has been recorded in the RAMs 41 and 42 in the manner as described above, after turning on the MEMORY PLAY switch 37 (step S1) steps S5 and S6 are executed, and then performance in mode No. 1, No. 2, No, 5 or No. 6 is executed in a step S7.

For the performance in mode No. 7 the CHORD switch 11 is switched to the FINGERED or ON position after the switch operation described above. As a result, a steps S6, S8 and S9 are executed, and performance, is produced in a processing (to be described later) in a step S10.

For the performance in mode No. 3 or 8, the START/STOP switch 18 is turned on after the switch operation described above. As a result, the performance is executed (through a processing in a step S11 to be described later).

For the performance in mode No. 4 or No. 6, the MEMORY PLAY START/STOP switch 28 is turned on after the switch operation described above. As a result, the performance is executed (through a processing in a step S12 to be described later).

For performance by the guide display members 6, the MELODY GUIDE switch 38 is turned on. As a result, melody data and chord data are successively read out from the melody RAM 41 and chord RAM 42 respectively so that corresponding display members 6 are successively turned on to indicate the respective notes. Training performance thus can be executed following the indication by the guide display members 6 (step S13).

Figure 15:
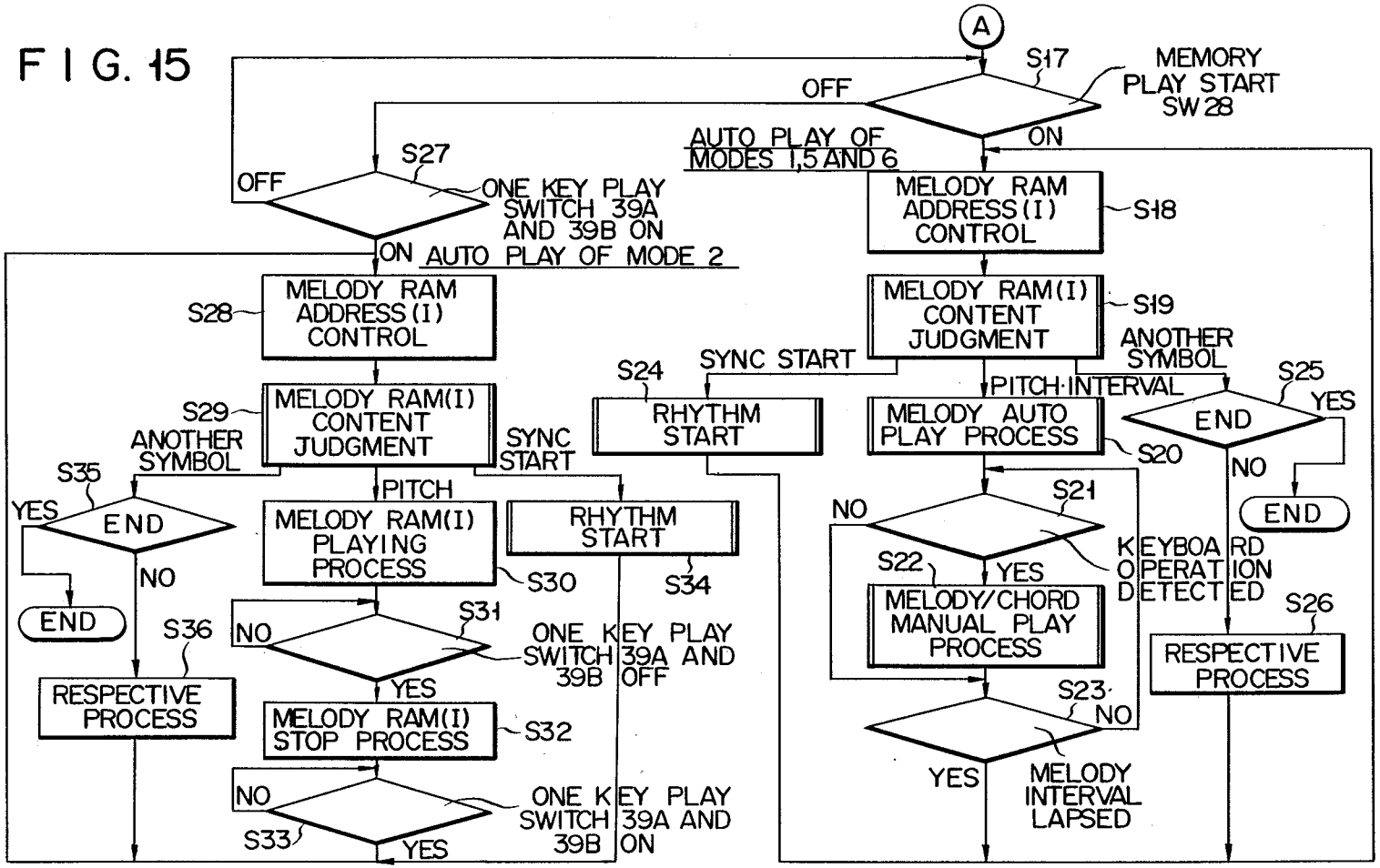
FIG. 15 is a flow chart for explaining the operation of the embodiment in selected performance modes.

Now, the aforementioned processing in modes No. 1, No. 2 and No. 5 will be described in detail with reference to FIG. 15. In mode No. 1, only the automatic performance of the melody is executed in the first channel of the LSI chip 45. In this case when the "on" operation of the MEMORY PLAY START/STOP switch 28 is detected in a step S17, the melody RAM 41 is address-controlled by the address counter Ad1 whereby melody data are successively read out (step S18). The read-out data are supplied to the CPU 43 so that their content is judged (step S19). When data for a pitch and tone interval is read out, automatic performance processing for that tone is executed in the first channel of the LSI chip 45 under the control of the CPU 43. In the present case, the keyboard 2 is not operated. This is detected in a step S22, and in a subsequent step S22 whether the time corresponding to the tone interval data has been elapsed is checked. In this case, the read-out tone interval data, for instance, is preset in the melody tone interval counter, and whether the counter content has been reduced to zero with the decrementing function of the counter is judged in a step S23. The steps S21 to S23 are repeatedly executed for sound production until the period of the tone interval data has elapsed. Also, when the period of the tone interval data has elapsed, the operation returns to the step S18 for reading out the next melody data.

If data other than the pitch, tone interval and end mark, for instance a rest code, is detected in the step S19, a relevant processing is executed in step S26. An end mark is detected in step S25. In this case, a processing for stopping the automatic performance of melody is executed.

In mode No. 5, a processing for the automatic performance of melody is executed simultaneously with the processing for the automatic performance of melody as in mode No. 1 in the second to fourth channels of the LSI chip 45 and in the first to fourth channels of the LSI chip 46. In this case, the operation of keys on the keyboard 2 is detected in step S21, and a processing for the manual performance is executed in step S22.

In mode No. 6 the automatic performance of chord and automatic performances of bass and arpeggio are executed in addition to the processing as in mode No. 1. The processing for the manual performance of a chord is thus executed in the step S22. When a sync start mark is detected in the step S19, a step S24 is executed, in which the CPU 43 gives a rhythm generating instruction to a rhythm source circuit 48 to start the rhythm performance.

In the melody one-key play in mode No. 2, when the ONE-KEY PLAY switch 39-A or 39-B is turned on in the "off" state of the MEMORY PLAY START/-STOP switch 28, the performance is started (step S27). Thus, melody data is read out from the melody RAM 41, and its content is judged (through processings in steps S28 and S29). When pitch data is read out, the corresponding tone is produced in the first channel of the LSI chip 45, and this sound is produced while the ONE-KEY PLAY switch 39-A or 39-B is "on" (steps S30 and S31). When the ONE-KEY PLAY switch 39-A and 39-B is turned off, the tone vanishes to be ready for the next "on" operation of the ONE-KEY PLAY switch 39-A or 39-B (steps S32 and S33). When the ONE KEY PLAY switch is turned on again, the operation returns to step S28 to start reading of the next melody data.

When a sync start mark is read out as the melody data, this is judged in a processing in step S29. Then, in step S34, rhythm start is caused in the same manner as described above. In the above way, automatic rhythm performance is executed in the LSI chip 47.

When a data other than pitch data, sync start mark or end mark is read out, a corresponding processing is executed in step S36. When an end mark is read out, the one-key play performance is ended (step S35).

Figure 16:
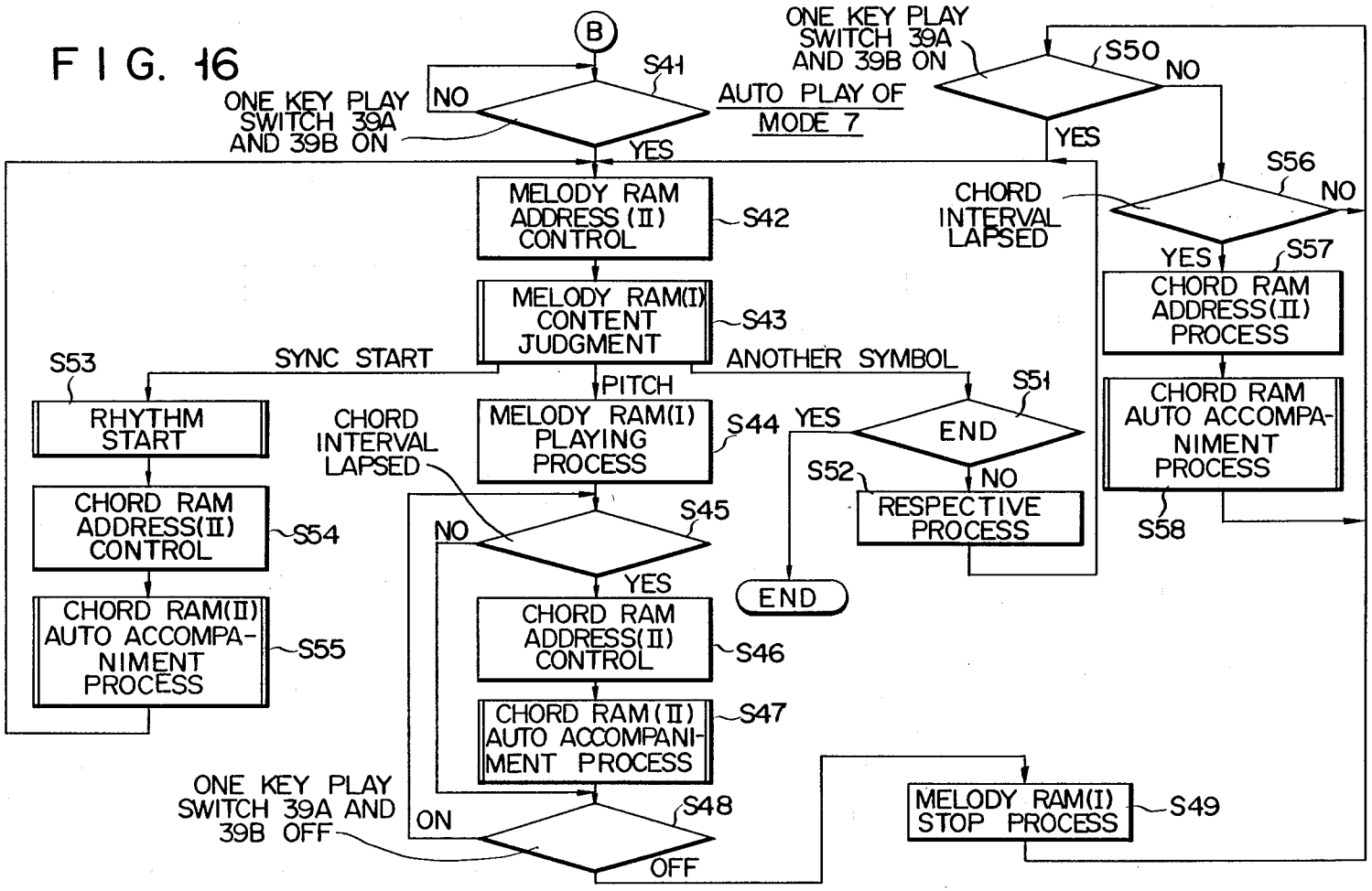
FIG. 16 is a flow chart for explaining the operation in mode No. 7.

Now, the operation in mode No. 7 will be described in detail with reference to FIG. 16. In mode No. 7, the one-key play performance of melody and automatic performance of chord are simultaneously executed. More particularly, when ONE-KEY PLAY switch 39-A or 39-B is turned on, the reading of melody data from the melody RAM 41 is started, and the content of the read-out data is judged in a processing through steps S41 to S43. If the read-out data is pitch data, the generation of the corresponding tone is caused in step S44. In a case where chord data is also being read out from the chord RAM 42, whether the tone interval of a chord has elapsed is checked in a step S45. If it is determined that the tone interval of the chord has not yet elapsed and the ONE-KEY PLAY switch 39-A or 39-B is "on", the steps S45 to S48 are repeatedly executed. Thus, both the one-key play and automatic performance of a chord are simultaneously executed. If it is determined that the tone interval of a chord, for instance, has elapsed, the next chord data is read out through the processing of steps S46 and S47, and the automatic performance of that chord is started. If the ONE-KEY PLAY switch 39-A or 39-B is turned off, this is detected in step S48, and the prevailing tone is muted in step S49. Then, step S50 is executed, which checks whether or not the ONE-KEY PLAY switch 39-A or 39-B is turned on. If it is detected that the ONE-KEY PLAY switch 39-A or 39-B is turned on again, the step S42 is executed, in which the processing of the next melody data is started.

If data other than the pitch data, sync start mark or end mark is detected in the step S43, the operation proceeds through a step S51 to a step S52, and after the execution of a corresponding processing it returns to step S42. If an end mark is read out, this is detected in the step S51, so that the one-key play performance, automatic performance or rhythm and automatic performance of chord are ended.

If a sync start mark is read out as melody data during the one-key play performance of melody, the rhythm performance is started in step S53. Also, from that instant the reading of chord data from the chord RAM 42 is started to start the automatic performance of a chord, and it is continued (through the processing of steps S54 and S55).

If it is detected in step S50 that the one-key play switch 39-A or 39-B is "off", step S56 checks whether the tone interval of the chord has elapsed. If it is detected that the tone interval of the chord has not elapsed, the operation returns to the step S50. If it is determined in the step S56 that the tone interval of the chord has elapsed, steps S57 and S58 are executed to renew the address of the chord RAM 42 and start the automatic performance by reading out the next chord data.

When a sync mark is read out in step S43, it is ready to produce automatic performance of chords to the one-key playing of melody.

Figure 17:
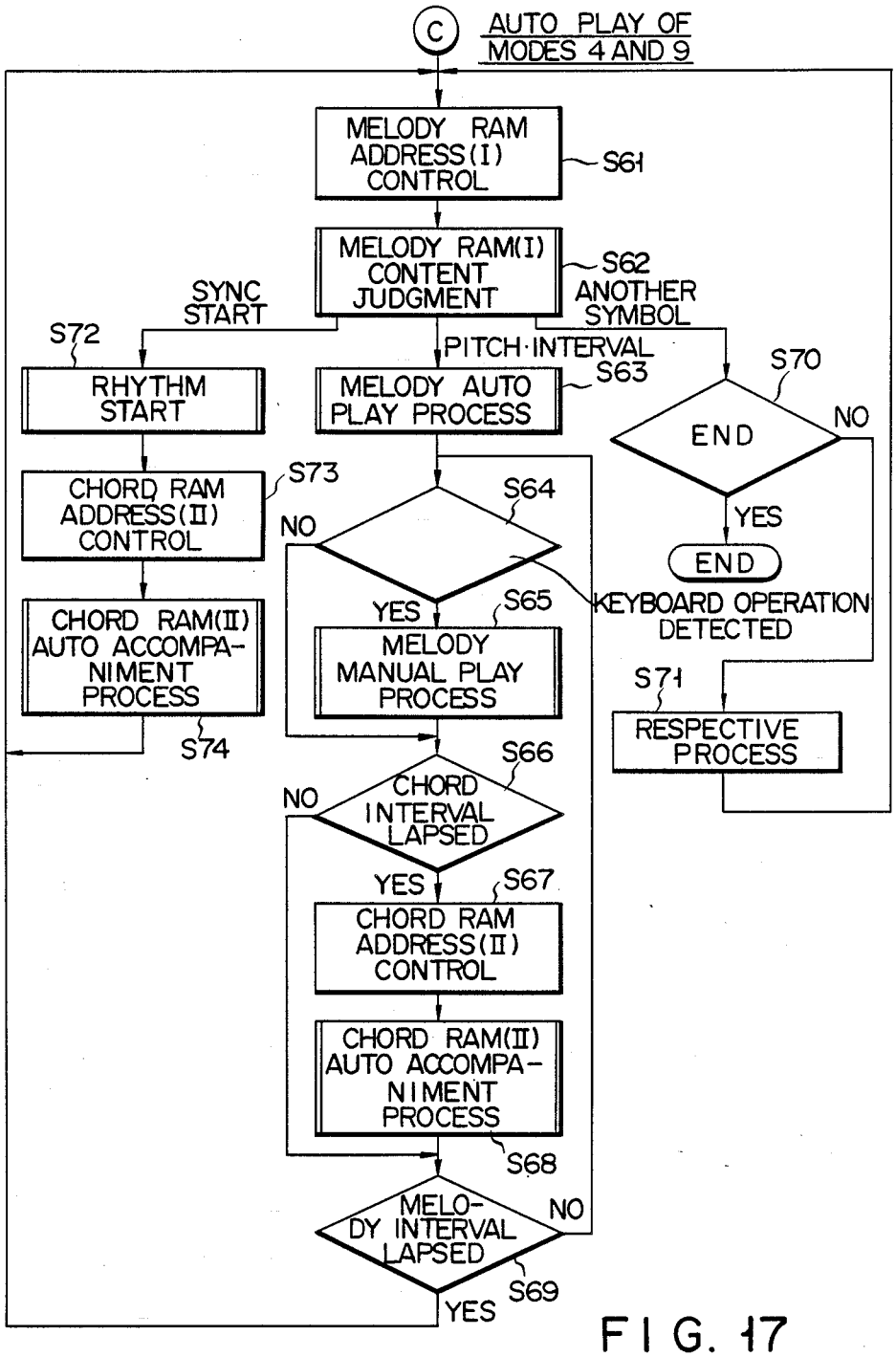
FIG. 17 is a flow chart for explaining the operation in modes, No. 4 and No. 9.

Now, the operation in modes No. 4 and No. 9 will be described with reference to the flow chart of FIG. 17. In mode No. 4, the automatic performance of melody and automatic performance of chord are simultaneously executed. In this case, melody data is read out from the melody RAM 41, and its content is judged (steps S61 and S62). If the melody data is the pitch data or tone interval data, the corresponding tone is produced (step S63). In the present case, no key on the keyboard 2 is operated, so that a step S66 is executed after a step S64 subsequent to the step S63. In the step S66 whether the tone interval of a chord which is simultaneously read from the chord RAM 42 has elapsed, is checked. If it is detected that the tone interval has not elapsed, a step S69 is executed, which checks whether the tone interval of the melody being produced has elapsed. If it is determined that the tone interval of melody also has not elapsed, the steps S64, S66 and S69 are repeatedly executed. If the tone interval of the chord has been elapsed, this is detected in the step S66, and the next chord data is read out and the performance of that chord is started (steps S67 and S68). If the tone interval of melody has been elapsed, this is detected in step S69, and the operation is returned to step S61 to read out the next melody data.

If data other than the tone interval data, pitch data, sync start mark and end data is read out as the melody data, a corresponding processing is executed in step S71. If an end mark is read out, the automatic performance of melody and automatic performance of chords are stopped (step S70).

If a sync start mark is read out in the step S62, a step S72 is executed to start the rhythm. Also, from that instant the automatic performance of chords is started (steps S73 and S74).

In mode No. 9 manual performance of melody is produced simultaneously with the performances as in mode No. 4. In this case, whether any key on the keyboard 2 is operated during the automatic performance of melody and automatic performance of chord, is checked (step S64). If a key operation is detected, step S65 is executed, in which a processing for manual performance of the melody is done in the second to fourth channel of the LSI chip 45.

Figure 18:
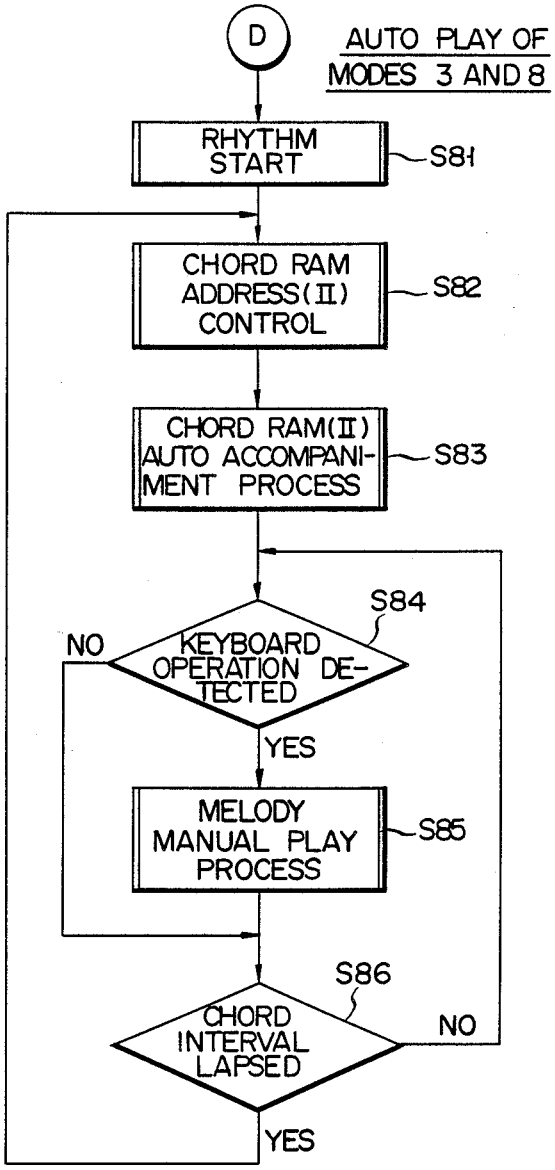
FIG. 18 is a flow chart for explaining the operation in modes No. 3 and No. 8.

Now, the operation in modes No. 3 and No. 8 will be described with reference to the flow chart of FIG. 18. In mode No. 3 only the automatic performance of chord is executed. In this case, when the chord data starts to be read out from the chord RAM 42, a processing for the automatic performance of chord is done (steps S82 and S83). Since in the present case no key on the keyboard 2 is operated, after step S84 subsequent to the step S83 step S86 is executed, in which whether the tone interval of a chord has elapsed is checked. Until the lapse of the tone interval the automatic performance of chords is executed. When the tone interval has elapsed, the operation is returned to step S82 to read out the next chord data.

In mode No. 8 manual performance of melody is produced simultaneously with the performance in mode No. 3. In this case, whether any key on the keyboard 2 is operated during the automatic performance of a chord is checked in step S84. If a key operation is detected, processing for the manual performance of melody is executed in step S85.

While in the above embodiment nine different modes are obtained as different forms of automatic performance, it is also possible to permit one-key play of melody and automatic performance of melody simultaneously and with different contents, and permit manual performance of melody and one-key play of melody. Further, various other combination modes for automatic performance can be provided.

As has been described in the foregoing, according to the invention, a variety of performance modes are possible such as simultaneous combination of automatic performance of chord and automatic performance of melody, simultaneous combination of one-key play of melody and automatic performance of chords, simultaneous combination of automatic performance of melody, automatic performance of chords and manual performance of melody, and simultaneous combination of automatic performance of melody, manual performance of melody and manual performance of chord, with a single electronic musical instrument.

What is claimed is:

1. An electronic musical instrument with an automatic performing function, comprising:

melody tone data storing means for storing tone name, tone octave and tone interval data;

chord tone data storing means for storing chord name and chord tone interval data, said chord name data being subdivided into chord root data and chord classification data;

said melody tone data and chord tone data being stored in their respective storing means in the same format, including a common format for melody tone name data and chord root data, a common format for melody tone octave data and chord classification data, and a common format for melody tone interval data and chord tone interval data;

musical tone signal generating means including at least one output processing unit having a plurality of time-division-switched channels for producing respective musical tone signals selectively responsive to the melody tone data supplied from said melody tone data storing means and to the chord data supplied from said chord tone data storing means, said output processing unit being capable of producing one or more musical tones simultaneously, each tone in a separate time-division-switched channel;

first automatic control means for successively reading out, and supplying to said musical tone signal generating means, melody tone data stored in said melody tone data storing means;

second automatic control means for successively reading out, and supplying to said musical tone signal generating means, chord tone data stored in said chord tone data storing means; and operating mode selection means coupled to said first and said second automatic control means for selecting one of several automatic operation modes among which there are, at least, one mode in which only said first automatic control means is rendered operative, one mode in which only said second automatic control means is rendered operative and one mode in which both said first and second automatic control means are rendered operative.

2. An electronic musical instrument according to claim 1, wherein said melody tone data includes in said format a place for a sync start mark and said melody tone data storing means further includes means for storing a sync start mark at a preselected position for designating a sync start operation of rhythm performance, and said instrument further includes a rhythm performance means for generating rhythm sounds according to a preselected rhythm pattern and means for a starting operation of the rhythm performance means when a sync start mark is read out from the melody tone data storing means by said first automatic control means.

3. An electronic musical instrument according to claim 1, wherein said melody tone data includes in said format a place for a sync start mark and said melody tone data storing means further includes means for storing a sync start mark at a preselected position for designating a syncro start operation of chord performance executed by the second automatic control means and means for starting chord performance when the sync start mark is read out from the melody tone data storing means.

4. An electronic musical instrument according to claim 1, wherein said first automatic control means includes one-key play switch means for successively reading out melody tone data stored in said melody tone data storing means.

5. An electronic musical instrument according to claim 2, wherein said common format for melody tone name data and chord root data leaves four codes available for special marks and wherein at least in said melody tone data storing means said special mark codes include said sync start mark, a mark indicating a rest and a mark indicating end of automatic performance.

6. An electronic musical instrument according to claim 3, wherein said common format for melody tone name data and chord root data leaves four codes available for special marks and wherein at least in said melody tone data storing means said special mark codes include said sync start mark, a mark indicating a rest and a mark indicating end of automatic performance.

7. An electronic musical instrument according to claim 1, wherein said at least one output processing unit comprises a single central processing unit and a plurality of subsidiary output processing units each capable of producing up to at least four tones simultaneously, each tone in a separate time-division-switched channel, and also comprises a common mixing circuit.

8. An electronic musical instrument according to claim 7, wherein said at least one output processing unit comprises three said subsidiary output processing units each capable of producing up to four tones simultaneously, each tone in a separate time-division switched channel.

* * * * *